US011519281B2

(12) United States Patent
Dutta et al.

(10) Patent No.: US 11,519,281 B2
(45) Date of Patent: Dec. 6, 2022

(54) IMPINGEMENT INSERT FOR A GAS TURBINE ENGINE

(71) Applicant: General Electric Company, Schenectady, NY (US)

(72) Inventors: Sandip Dutta, Greenville, SC (US); Benjamin Paul Lacy, Greer, SC (US); Gary Michael Itzel, Simpsonville, SC (US); Zachary John Snider, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/118,792

(22) Filed: Dec. 11, 2020

(65) Prior Publication Data

US 2021/0270141 A1 Sep. 2, 2021

Related U.S. Application Data

(63) Continuation of application No. 15/364,710, filed on Nov. 30, 2016, now abandoned.

(51) Int. Cl.
*F01D 9/06* (2006.01)
*F01D 5/18* (2006.01)
(Continued)

(52) U.S. Cl.
CPC ..... *F01D 9/065* (2013.01); *F01D 5/189* (2013.01); *F01D 11/08* (2013.01); *F01D 25/14* (2013.01);
(Continued)

(58) Field of Classification Search
CPC ..... F01D 5/189; F01D 9/065; F01D 25/14; F05D 2220/30; F05D 2260/201; F05D 2260/22141; F28F 3/02; F28F 3/022
See application file for complete search history.

(56) References Cited

U.S. PATENT DOCUMENTS 1,324,714 A 12/1919 Allen
3,806,276 A 4/1974 Aspinwall
(Continued)

FOREIGN PATENT DOCUMENTS

EP 1188902 A1 3/2002
EP 1544414 A1 6/2005
(Continued)

OTHER PUBLICATIONS

JP-H0552201-U Foreign reference and English Translation (Year: 2022).*
(Continued)

*Primary Examiner* — Topaz L. Elliott
*Assistant Examiner* — Aye S Htay
(74) *Attorney, Agent, or Firm* — Dority & Manning, P.A.

(57) ABSTRACT

The present disclosure is directed to a turbomachine that includes a hot gas path component having an inner surface and defining a hot gas path component cavity. An impingement insert is positioned within the hot gas path component cavity. The impingement insert includes an inner surface and an outer surface and defines an impingement insert cavity and a plurality of impingement apertures fluidly coupling the impingement insert cavity and the hot gas path component cavity. A plurality of pins extends from the outer surface of the impingement insert to the inner surface of the hot gas path component.

20 Claims, 9 Drawing Sheets

(51) Int. Cl.
*F01D 11/08* (2006.01)
*F01D 25/14* (2006.01)

(52) U.S. Cl.
CPC .... *F05D 2220/30* (2013.01); *F05D 2260/201* (2013.01); *F05D 2260/22141* (2013.01); *F05D 2260/30* (2013.01)

(56) References Cited

U.S. PATENT DOCUMENTS

| | | | | |
|---|---|---|---|---|
| 3,902,820 | A | 9/1975 | Amos | |
| 4,297,077 | A | 10/1981 | Durgin et al. | |
| 4,695,247 | A * | 9/1987 | Enzaki | F23R 3/002 431/351 |
| 5,253,976 | A | 10/1993 | Cunha | |
| 5,340,274 | A | 8/1994 | Cunha | |
| 5,586,866 | A * | 12/1996 | Wettstein | F23R 3/002 416/96 A |
| 5,993,156 | A | 11/1999 | Bailly et al. | |
| 6,227,804 | B1 | 5/2001 | Koga et al. | |
| 6,237,344 | B1 | 5/2001 | Lee | |
| 7,008,178 | B2 | 3/2006 | Busch et al. | |
| 8,052,390 | B1 | 11/2011 | Liang | |
| 8,079,821 | B2 * | 12/2011 | Campbell | F01D 5/18 416/232 |
| 8,109,724 | B2 | 2/2012 | Malecki et al. | |
| 8,777,569 | B1 | 7/2014 | Liang | |
| 8,939,706 | B1 | 1/2015 | Lee et al. | |
| 9,133,717 | B2 | 9/2015 | Nakamata et al. | |
| 9,896,943 | B2 | 2/2018 | Crosatti et al. | |
| 9,976,441 | B2 | 5/2018 | Lacy et al. | |
| 10,184,343 | B2 | 1/2019 | Lacy et al. | |
| 10,253,986 | B2 | 4/2019 | Lacy et al. | |
| 10,739,087 | B2 | 8/2020 | Lacy et al. | |
| 2010/0054915 | A1 | 3/2010 | Devore et al. | |
| 2010/0247284 | A1 | 9/2010 | Gregg et al. | |
| 2014/0093379 | A1 | 4/2014 | Tibbott et al. | |
| 2014/0093387 | A1 | 4/2014 | Pointon et al. | |
| 2014/0093392 | A1 * | 4/2014 | Tibbott | F01D 5/188 29/889.6 |
| 2014/0105726 | A1 | 4/2014 | Lee | |
| 2014/0219788 | A1 | 8/2014 | Nilsson | |
| 2014/0348665 | A1 | 11/2014 | Smith | |
| 2015/0135720 | A1 | 5/2015 | Papple et al. | |
| 2015/0345397 | A1 | 12/2015 | Bunker et al. | |
| 2016/0102563 | A1 * | 4/2016 | Spangler | F01D 5/189 415/115 |
| 2016/0153299 | A1 | 6/2016 | Tuertscher et al. | |
| 2016/0230566 | A1 * | 8/2016 | King | F23R 3/002 |
| 2016/0312624 | A1 | 10/2016 | Loricco et al. | |
| 2016/0312630 | A1 | 10/2016 | Davis, III et al. | |
| 2016/0348536 | A1 * | 12/2016 | Lacy | F01D 25/12 |
| 2017/0058679 | A1 * | 3/2017 | Spangler | B23P 15/02 |
| 2017/0067636 | A1 | 3/2017 | Lacy et al. | |
| 2017/0067699 | A1 | 3/2017 | Lacy et al. | |
| 2017/0167274 | A1 | 6/2017 | Itzel | |
| 2017/0175577 | A1 | 6/2017 | Dutta | |
| 2017/0226892 | A1 | 8/2017 | Lacy et al. | |
| 2017/0356299 | A1 | 12/2017 | Dutta et al. | |
| 2017/0356341 | A1 | 12/2017 | Dutta | |
| 2018/0023395 | A1 | 1/2018 | Jones et al. | |
| 2018/0163545 | A1 | 6/2018 | Bang | |
| 2018/0274377 | A1 | 9/2018 | Kington et al. | |
| 2018/0328224 | A1 * | 11/2018 | Dutta | F01D 25/12 |
| 2019/0017392 | A1 | 1/2019 | Dutta et al. | |

FOREIGN PATENT DOCUMENTS

| | | | |
|---|---|---|---|
| FR | 2962484 | A1 | 1/2012 |
| JP | H04265403 | A | 9/1992 |
| JP | H0552201 | U * | 7/1993 |

OTHER PUBLICATIONS

European Search Report and Opinion Corresponding to EP17203847 dated Apr. 23, 2018.

* cited by examiner

IMPINGEMENT INSERT FOR A GAS TURBINE ENGINE

CROSS-REFERENCE TO RELATED APPLICATIONS

The present application is a continuation application, which claims priority to U.S. application Ser. No. 15/364,710, filed Nov. 30, 2016, the entire disclosure of which is incorporated by reference herein.

FIELD OF THE TECHNOLOGY

The present disclosure generally relates to gas turbine engines. More particularly, the present disclosure relates to impingement inserts for gas turbine engines.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section includes one or more turbine nozzles, which direct the flow of combustion gases onto one or more turbine rotor blades. The one or more turbine rotor blades, in turn, extract kinetic energy and/or thermal energy from the combustion gases, thereby driving the rotor shaft. In general, each turbine nozzle includes an inner side wall, an outer side wall, and one or more airfoils extending between the inner and the outer side walls. Since the one or more airfoils are in direct contact with the combustion gases, it may be necessary to cool the airfoils.

In certain configurations, cooling air is routed through one or more inner cavities defined by the airfoils. Typically, this cooling air is compressed air bled from compressor section. Bleeding air from the compressor section, however, reduces the volume of compressed air available for combustion, thereby reducing the efficiency of the gas turbine engine.

BRIEF DESCRIPTION OF THE TECHNOLOGY

Aspects and advantages of the technology will be set forth in part in the following description, or may be obvious from the description, or may be learned through practice of the technology.

In one embodiment, the present disclosure is directed to a turbomachine that includes a hot gas path component having an inner surface to be cooled and defining a hot gas path component cavity. An impingement insert is positioned within the hot gas path component cavity. The impingement insert includes an inner surface and an outer surface and defines an impingement insert cavity and a plurality of impingement apertures fluidly coupling the impingement insert cavity and the hot gas path component cavity. A plurality of pins extends from the outer surface of the impingement insert to the inner surface of the hot gas path component.

In another embodiment, the present disclosure is directed to a gas turbine engine that includes a hot gas path component having an inner surface and defining a hot gas path component cavity. An impingement insert is positioned within the hot gas path component cavity. The impingement insert includes an inner surface and an outer surface and defines an impingement insert cavity and a plurality of impingement apertures fluidly coupling the impingement insert cavity and the hot gas path component cavity. Each impingement aperture includes an impingement aperture diameter. A plurality of projections extends outwardly from outer surface of the impingement insert. Each projection is spaced apart from each impingement aperture by a minimum distance of at least two times the impingement aperture diameter.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
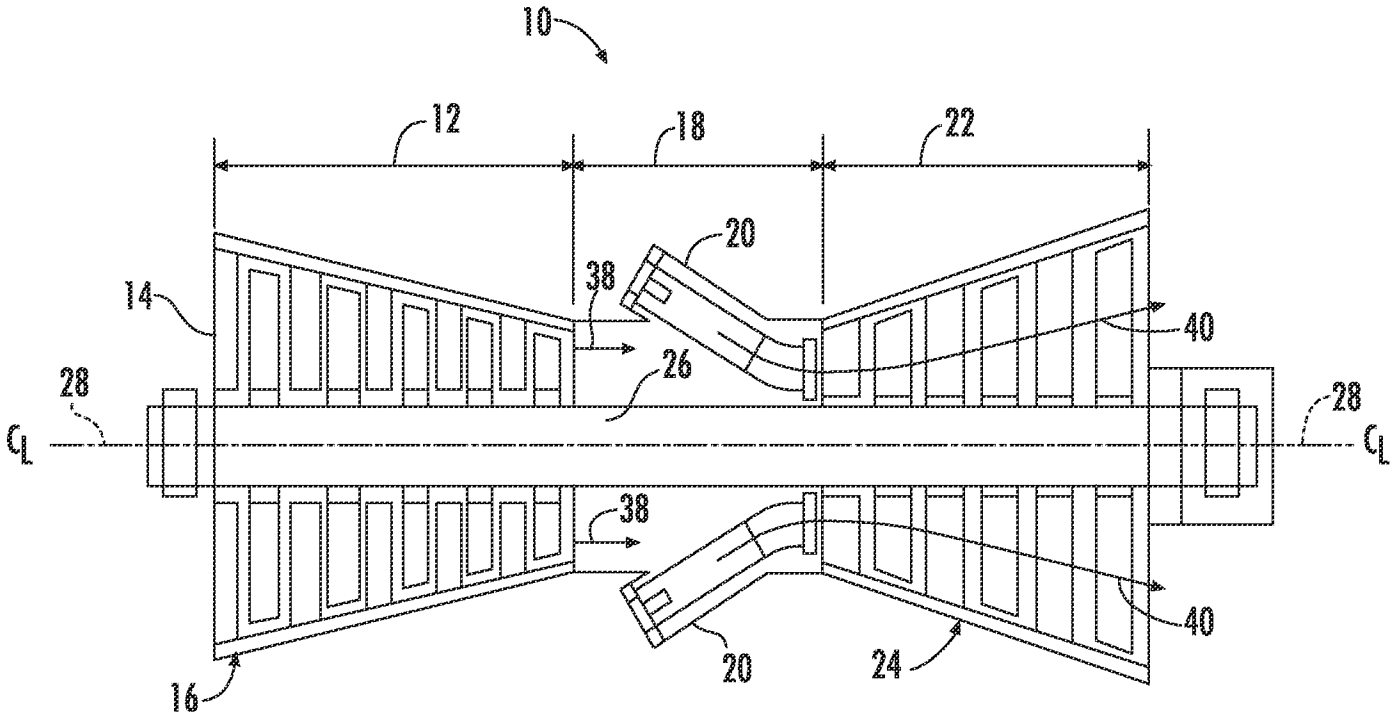
FIG. 1 is a schematic view of an exemplary gas turbine engine in accordance with embodiments of the present disclosure.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

Referring now to the drawings, FIG. 1 is a schematic of an exemplary turbomachine, such a gas turbine engine 10. As shown, the gas turbine engine 10 generally includes a compressor section 12 having an inlet 14 disposed at an upstream end of an axial compressor 16. The gas turbine engine 10 further includes a combustion section 18 having one or more combustors 20 positioned downstream from the compressor 16. The gas turbine engine 10 also includes a turbine section 22 having a turbine 24 (e.g., an expansion turbine) disposed downstream from the combustion section 18. A shaft 26 extends axially through the compressor 16 and the turbine 24 along an axial centerline 28 of the gas turbine engine 10.

Figure 2:
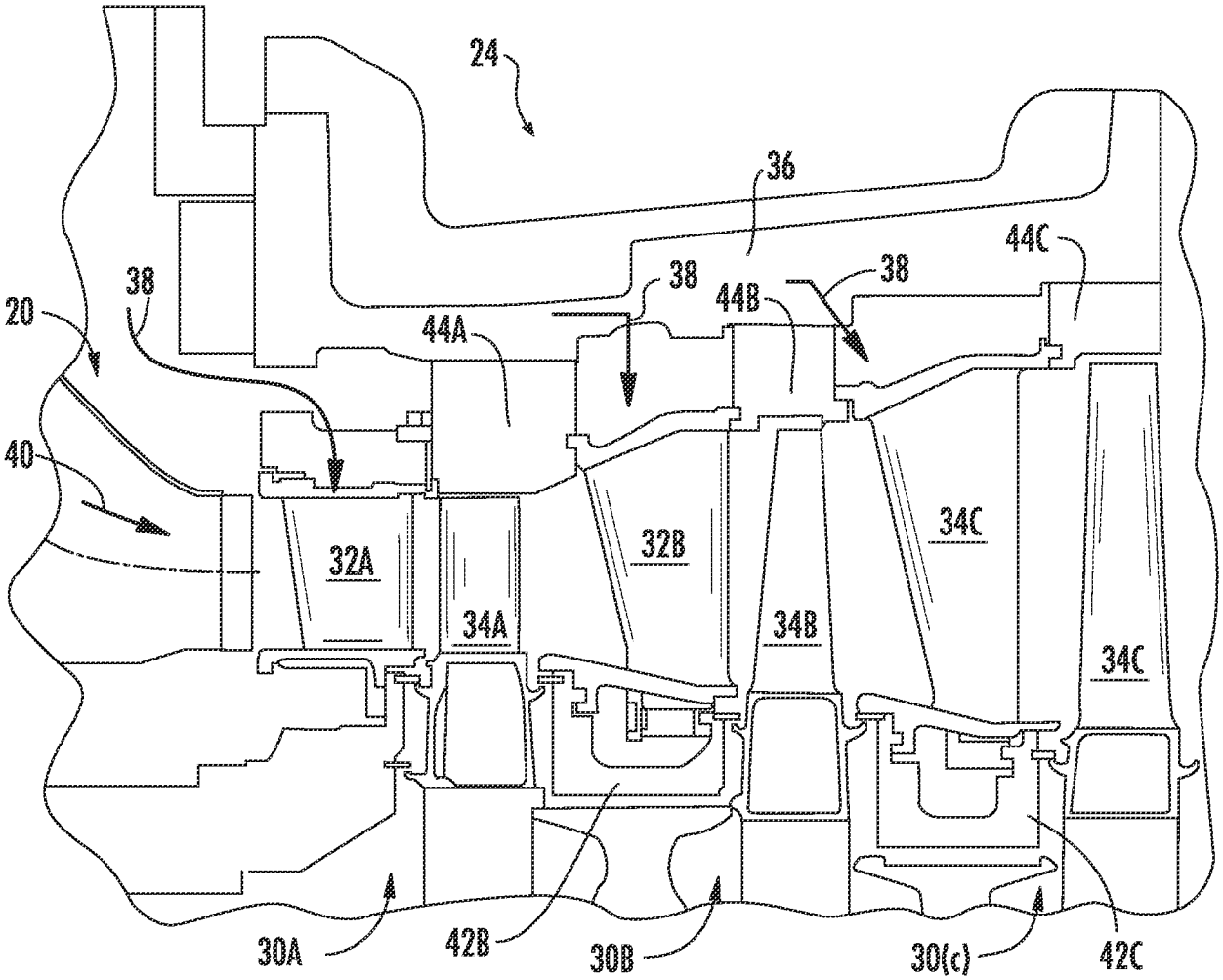
FIG. 2 is a cross-sectional view of an exemplary turbine section in accordance with embodiments of the present disclosure.

FIG. 2 is a cross-sectional side view of the turbine 24, which may incorporate various embodiments disclosed herein. As shown in FIG. 2, the turbine 24 may include multiple turbine stages. For example, the turbine 24 may include a first stage 30A, a second stage 30B, and a third stage 30C. Although, the turbine 24 may include more or less turbine stages as is necessary or desired.

Each stage 30A-30C includes, in serial flow order, a corresponding row of turbine nozzles 32A, 32B, and 32C and a corresponding row of turbine rotor blades 34A, 34B, and 34C axially spaced apart along the rotor shaft 26 (FIG. 1). Each of the turbine nozzles 32A-32C remains stationary relative to the turbine rotor blades 34A-34C during operation of the gas turbine 10. Each of the rows of turbine nozzles 32B, 32C is respectively coupled to a corresponding diaphragm 42B, 42C. Although not shown in FIG. 2, the row of turbine nozzles 32A may also couple to a corresponding diaphragm. A first turbine shroud 44A, a second turbine shroud 44B, and a third turbine shroud 44C circumferentially enclose the corresponding row of turbine blades 34A-34C. A casing or shell 36 circumferentially surrounds each stage 30A-30C of the turbine nozzles 32A-32C and the turbine rotor blades 34A-34C.

As illustrated in FIGS. 1 and 2, the compressor 16 provides compressed air 38 to the combustors 20. The compressed air 38 mixes with fuel (e.g., natural gas) in the combustors 20 and burns to create combustion gases 40, which flow into the turbine 24. The turbine nozzles 32A-32C and turbine rotor blades 34A-34C extract kinetic and/or thermal energy from the combustion gases 40. This energy extraction drives the rotor shaft 26. The combustion gases 40 then exit the turbine 24 and the gas turbine engine 10. As will be discussed in greater detail below, a portion of the compressed air 38 may be used as a cooling medium for cooling the various components of the turbine 24 including, inter alia, the turbine nozzles 32A-32C.

Figure 3:
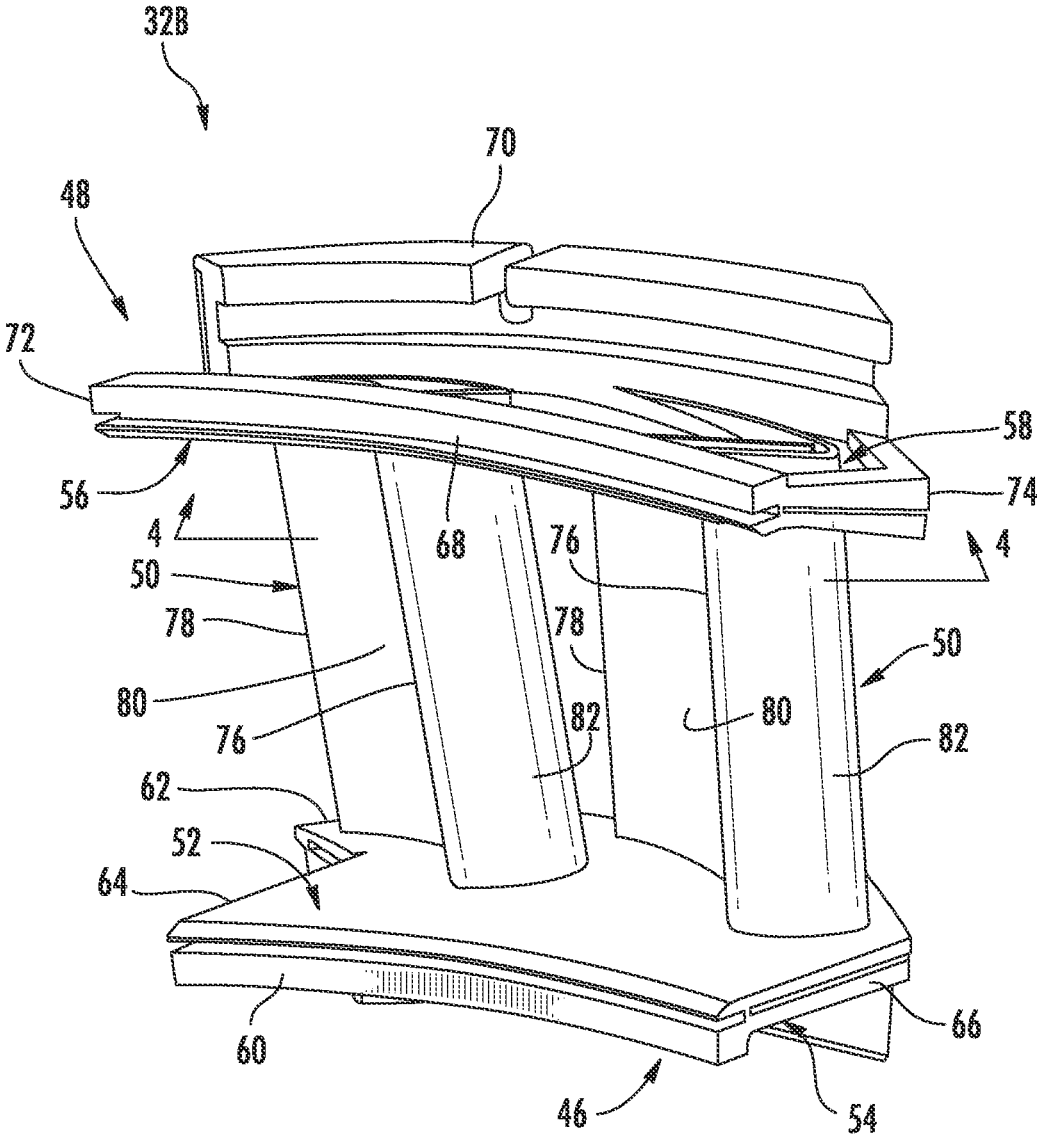
FIG. 3 is a perspective view of an exemplary nozzle in accordance with embodiments of the present disclosure.

FIG. 3 is a perspective view of the turbine nozzle 32B of the second stage 30B, which may also be known in the industry as the stage two nozzle or S2N. The other turbine nozzles 32A, 32C include features similar to those of the turbine nozzle 32B, which will be discussed in greater detail below. As shown in FIG. 3, the turbine nozzle 32B includes an inner side wall 46 and an outer side wall 48 radially spaced apart from the inner side wall 46. A pair of airfoils 50 extends in span from the inner side wall 46 to the outer side wall 48. In this respect, the turbine nozzle 32B illustrated in FIG. 3 is referred to in the industry as a doublet. Nevertheless, the turbine nozzle 32B may have only one airfoil 50 (i.e., a singlet), three airfoils 50 (i.e., a triplet), or more airfoils 50.

As illustrated in FIG. 3, the inner and the outer side walls 46, 48 include various surfaces. More specifically, the inner side wall 46 includes a radially outer surface 52 and a radially inner surface 54 positioned radially inwardly from the radially outer surface 52. Similarly, the outer side wall 48 includes a radially inner surface 56 and a radially outer surface 58 oriented radially outwardly from the radially inner surface 56. As shown in FIGS. 2 and 3, the radially inner surface 56 of the outer side wall 48 and the radially outer surface 52 of the inner side wall 46 respectively define the inner and outer radial flow boundaries for the combustion gases 40 flowing through the turbine 24. The inner side wall 46 also includes a forward surface 60 and an aft surface 62 positioned downstream from the forward surface 60. The inner side wall 46 further includes a first circumferential surface 64 and a second circumferential surface 66 circumferentially spaced apart from the first circumferential surface 64. Similarly, the outer side wall 48 includes a forward surface 68 and an aft surface 70 positioned downstream from the forward surface 68. The outer side wall 48 also includes a first circumferential surface 72 and a second circumferential surface 74 spaced apart from the first circumferential surface 72. The inner and the outer side walls 46, 48 are preferably constructed from a nickel-based superalloy or another suitable material capable of withstanding the combustion gases 40.

Figure 4:
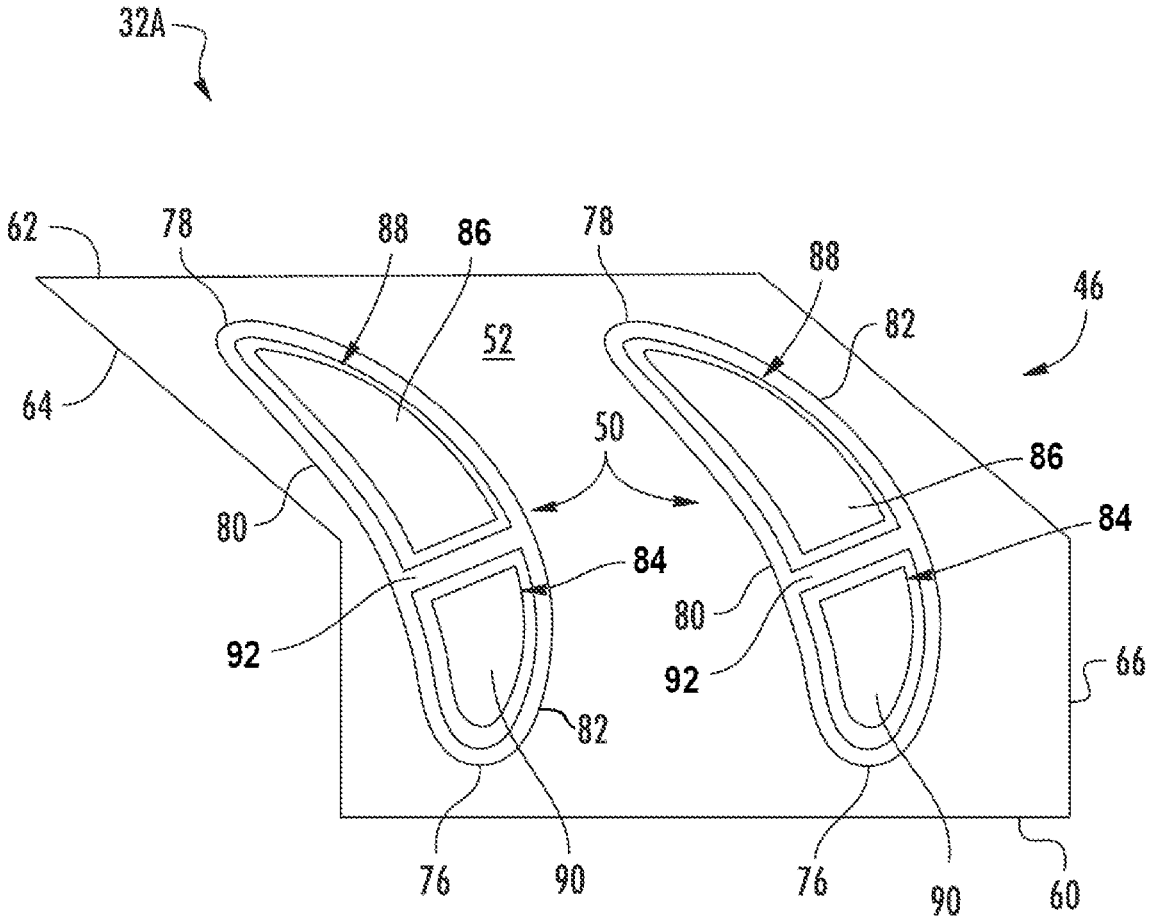
FIG. 4 is a cross-sectional view of the nozzle taken generally about line 4-4 in FIG. 3 in accordance with embodiments of the present disclosure.

As mentioned above, two airfoils 50 extend from the inner side wall 46 to the outer side wall 48. As illustrated in FIGS. 3 and 4, each airfoil 50 includes a leading edge 76 disposed proximate to the forward surfaces 60, 68 of the inner and the outer side walls 46, 48. Each airfoil 50 also includes a trailing edge 78 disposed proximate to the aft surfaces 62, 70 of the inner and the outer side walls 46, 48. Furthermore, each airfoil 50 includes a pressure side wall 80 and an opposing suction side wall 82 extending from the leading edge 76 to the trailing edge 78. The airfoils 50 are preferably constructed from a nickel-based superalloy or another suitable material capable of withstanding the combustion gases 40.

Each airfoil 50 may define one or more inner cavities therein. An insert may be positioned in each of the inner cavities to provide the compressed air 38 (e.g., via impingement cooling) to the pressure-side and suction-side walls 80, 82 of the airfoil 50. In the embodiment illustrated in FIG. 4, each airfoil 50 defines a forward inner cavity 84 having a forward insert 88 positioned therein and an aft inner cavity 86 having an aft insert 90 positioned therein. A rib 92 may separate the forward and aft inner cavities 84, 86. Nevertheless, the airfoils 50 may define one inner cavity, three inner cavities, or four or more inner cavities in alternate embodiments. Furthermore, some or all of the inner cavities may not include inserts in certain embodiments as well.

FIGS. 5-11 illustrate embodiments of an impingement insert 100, which may be positioned a hot gas path component cavity 102 of a hot gas path component 104. In some embodiments, the impingement insert 100 may be positioned in the forward inner cavity 86 of one of the airfoils 50 in the nozzle 32B in place of the forward insert 88 shown in FIG. 4. That is, the hot gas path component cavity 102 may be the forward inner cavity 86, and hot gas path component 104 may be the nozzle 32B. In further embodiments, the hot gas path component 104 may be other nozzles, one of the turbine shrouds 44A-44C, or one of the rotor blades 32A-32C. Nevertheless, the hot gas path component cavity 102 may be any suitable cavity in the gas turbine engine 10. Furthermore, the hot gas path component 104 may be any suitable component in the gas turbine engine 10.

The hot gas path component 104 is shown generically in FIGS. 5-11 as having an annular cross-section. Nevertheless, the hot gas path component 104 may be a flat plate or have any suitable cross-section and/or shape.

As illustrated in FIGS. 5-11, the impingement insert or plate 100 defines an axial direction A, a radial direction R, and a circumferential direction C. In general, the radial direction R extends orthogonally outward from the axial direction A, and the circumferential direction C extends concentrically around the axial direction A.

Figure 5:
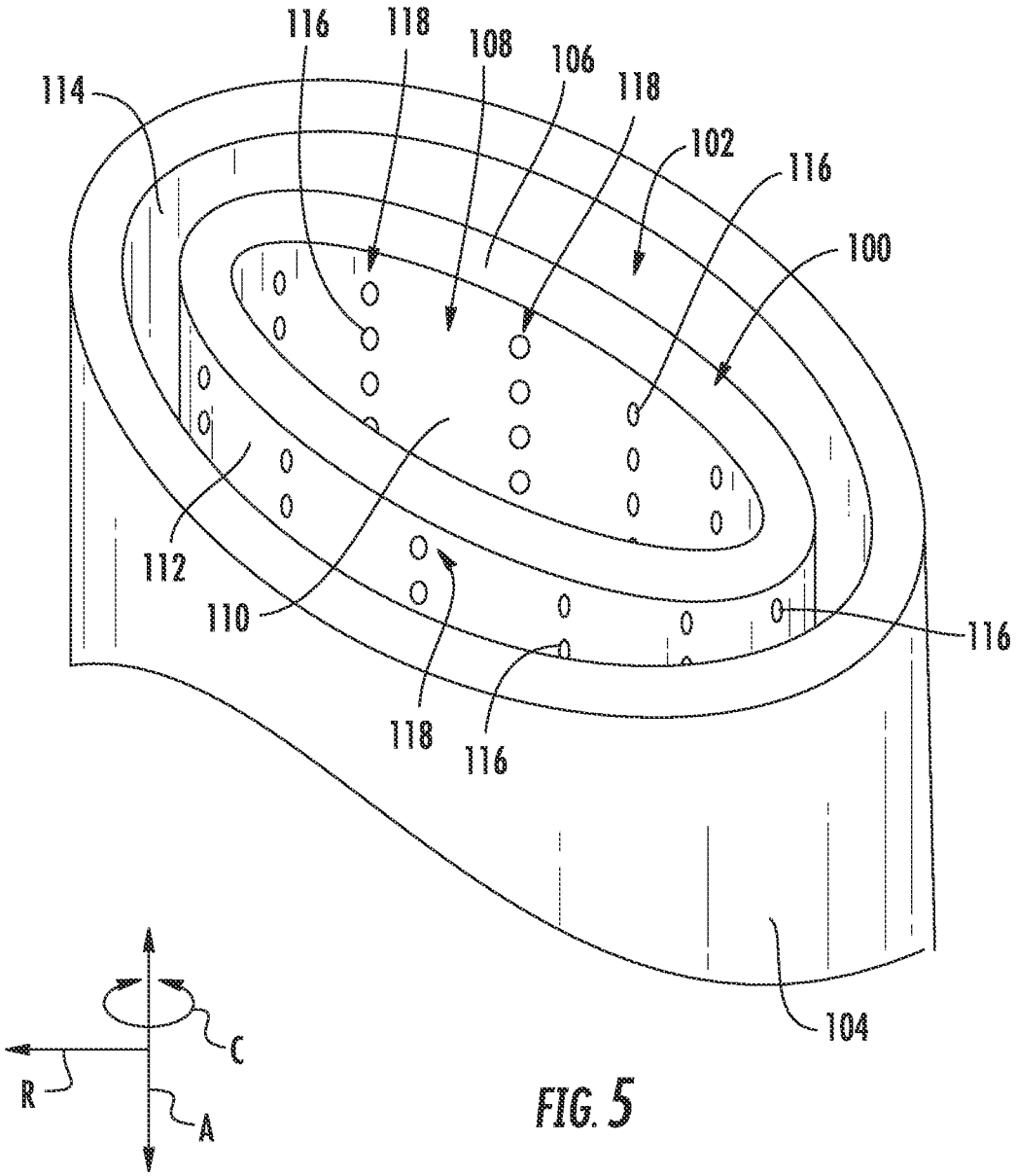
FIG. 5 is a perspective view of an embodiment of an impingement insert positioned within a hot gas path component in accordance with embodiments of the present disclosure.

Referring particularly to FIG. 5, the impingement insert 100 includes a generally tubular insert wall 106 that defines an impingement insert cavity 108 therein. In this respect, the insert wall 106 includes an inner surface 110, which forms the outer boundary of the impingement insert cavity 108, and an outer surface 112 spaced apart from the inner surface 110. In the embodiment illustrated in FIG. 5, the insert wall 106 generally has an annular cross-section. Although, the insert wall 106 may have any suitable shape in other embodiments as well.

As mentioned above, the impingement insert 100 is positioned in the hot gas path component cavity 102 of the hot gas path 104. More specifically, an inner surface 114 of the hot gas path component 104 forms the outer boundary of the hot gas path component cavity 102. The impingement insert 100 is positioned within the hot gas path component cavity 102 in such a manner that the outer surface 112 of the insert wall 106 is spaced apart from the inner surface 114 of the hot gas path component 104. The spacing between outer surface 112 of the insert wall 106 and the inner surface 114 of the hot gas path component 104 should be sized to facilitate impingement cooling of the inner the inner surface 114 as will be discussed in greater detail below.

Figure 6:
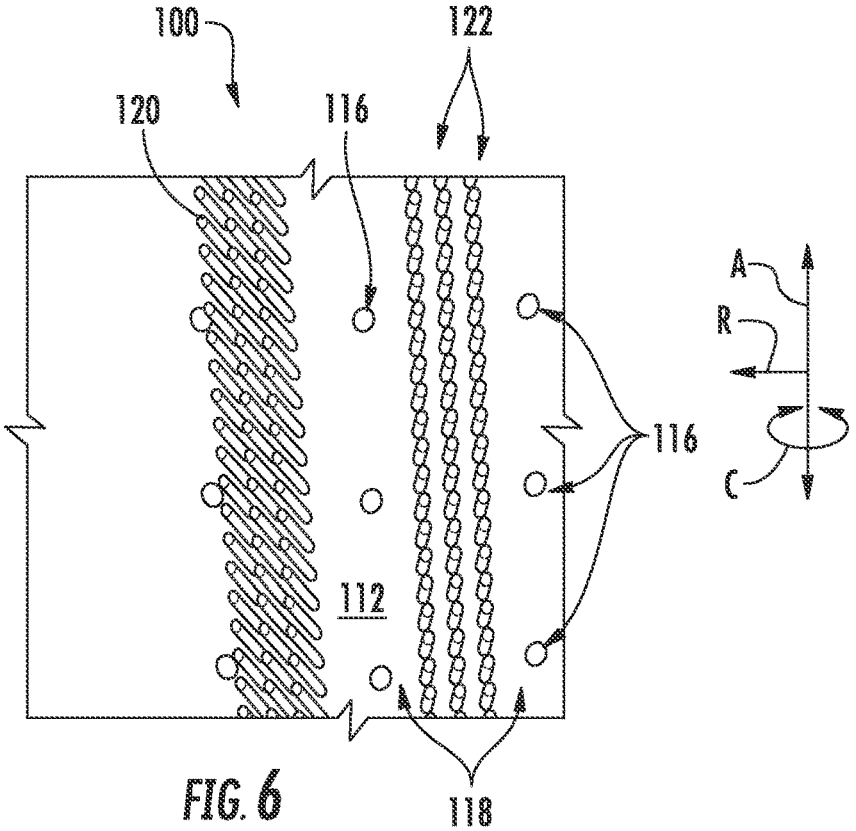
FIG. 6 is a perspective view of an embodiment of the impingement insert in accordance with embodiments of the present disclosure.

As illustrated in FIGS. 5-6, the impingement insert 100 defines a plurality of impingement apertures 116. In particular, the impingement apertures 116 extend through the insert wall 106 from the inner surface 110 thereof through the outer surface 112 thereof. The impingement apertures 116 provide fluid communication between the impingement insert cavity 108 and the hot gas path component cavity 102. The impingement apertures 116 preferably have a circular cross-section. Although, the impingement apertures 116 may have any suitable cross-section (e.g., rectangular, triangular, oval, elliptical, pentagonal, hexagonal, star-shaped, etc.). Furthermore, the impingement apertures 116 are sized to provide impingement cooling to the inner surface 114 of the hot gas path component 104.

In the embodiment shown in FIGS. 5 and 6, the impingement apertures 116 are arranged in linear rows 118. The linear rows 118 of impingement apertures 116 may extend along substantially the entire axial length of the insert wall 106 or only a portion thereof. The impingement apertures 116 may be arranged into any suitable number of linear rows 118. Nevertheless, the plurality of impingement apertures 116 may be arranged on the impingement insert 100 in any manner that facilitates impingement cooling of the inner the inner surface 114.

Referring particularly to FIG. 6, a plurality of projections 120 extends outwardly from the outer surface 112 of the insert wall 106. In the embodiment shown in FIG. 6, the projections 120 are arranged in linear rows 122. The linear rows 122 of projections 120 may extend along substantially the entire axial length of the insert wall 106 or only a portion thereof. For example, three linear rows 122 of projections 120 are circumferentially positioned between each adjacent pair of the linear rows 118 of impingement apertures 116 in the embodiment shown in FIG. 6. Nevertheless, the impingement apertures 116 may be arranged in any suitable number of linear rows 118. In fact, the plurality of projections 120 may be arranged on the impingement insert 100 in any suitable manner.

Figure 7:
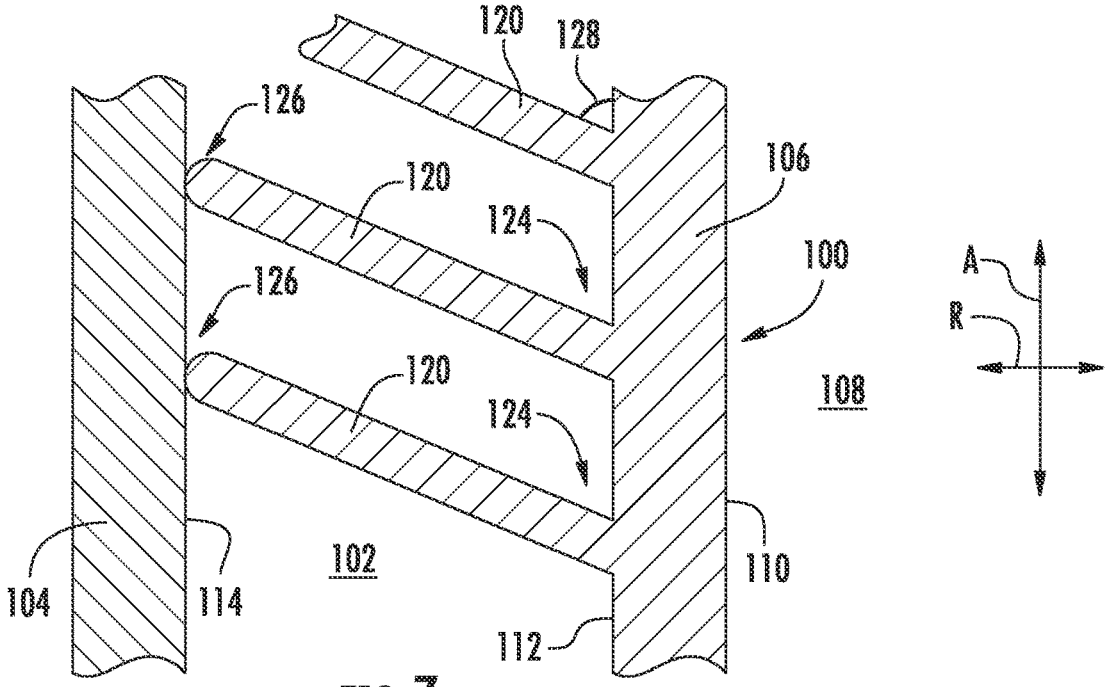
FIG. 7 is a cross-sectional view of an embodiment of the impingement insert and the hot gas path component in accordance with embodiments of the present disclosure.

As illustrated in FIG. 7, the projections 120 may be in contact with the inner surface 114 of the hot gas path component 104. That is, the projections 120 extend from the impingement insert 110 through the hot gas path component cavity 102 to the hot gas path component 104. In this respect, the projections 120 may conduct heat from the hot gas path component 104 to the impingement insert 100. More specifically, each of the projections 120 includes a first end 124 that couples to the outer surface 112 of the insert wall 106. In some embodiments, the projections 120 fixedly couple to the impingement insert 100. In particular, the projections 120 may be integrally formed with the impingement insert 100. Each of the projections 120 also includes a second end 126 that couples to the inner surface 114 of hot gas path component 104. In some embodiments, the projections 120 removably couple to the impingement insert 100. In particular, the second ends 126 of the projections 120 may be in sliding contact with the inner surface 114 of the hot gas path component 104. Nevertheless, the projections 120 may couple to the impingement insert 110 and the hot gas path component 104 in any suitable manner.

In the embodiment shown in FIGS. 6 and 7, the projections 120 may extend outward and upward from the outer surface 112 of the insert wall 106. As will be discussed in greater detail, the impingement insert 100 may be formed via additive manufacturing methods. In this respect, the upwardly angled orientation of the projections 120 provides the support necessary to form the projections 120 using additive manufacturing processes. In particular, the projections 120 may extend outwardly from the impingement insert 100 in the radial direction R and the axial direction A. In this respect, each projection 120 defines a pin angle 128 extending between the projection 120 and the outer surface 112 of the insert wall 106. In some embodiments, the pin angle 128 may be between thirty degrees and sixty degrees. In alternate embodiments, however, the projections 120 may extend outward from the insert wall 106 in only the radial direction R.

The projections 120 may have any suitable cross-section and/or shape. For example, the projections 120 may have a circular cross-section, a rectangular cross-section, or an elliptical cross-section. The projections 120 may have a constant thickness/diameter as the projections 120 extend outward from the insert wall 106. Alternately, the pins 120 may be tapered (i.e., narrower at the second end 126 than the first end 124).

As mentioned above, the impingement insert 100 is preferably formed via additive manufacturing. The term "additive manufacturing" as used herein refers to any process which results in a useful, three-dimensional object and includes a step of sequentially forming the shape of the object one layer at a time. Additive manufacturing processes include three-dimensional printing (3DP) processes, laser-net-shape manufacturing, direct metal laser sintering (DMLS), direct metal laser melting (DMLM), plasma transferred arc, freeform fabrication, etc. A particular type of additive manufacturing process uses an energy beam, for example, an electron beam or electromagnetic radiation such as a laser beam, to sinter or melt a powder material. Additive manufacturing processes typically employ metal powder materials or wire as a raw material. Nevertheless, the impingement insert 100 may be constructed using any suitable manufacturing process.

In one embodiment, the orientation and inherent flexibility of the projections 120 may permit insertion of the impingement insert 100 into the hot gas path component cavity 102. More specifically, as the impingement insert 100 enters the hot gas path component cavity 102, the second ends 126 of the projections 120 slide along the inner surface 114 of the hot gas path component 104. In this respect, the second ends 126 of the projections 120 flex axially upward and radially inward upon contact with the hot gas path component 104. The upward angle and the inherent flexibility of the projections 120 facilitate this elastic deformation of the projections 120.

Figure 8:
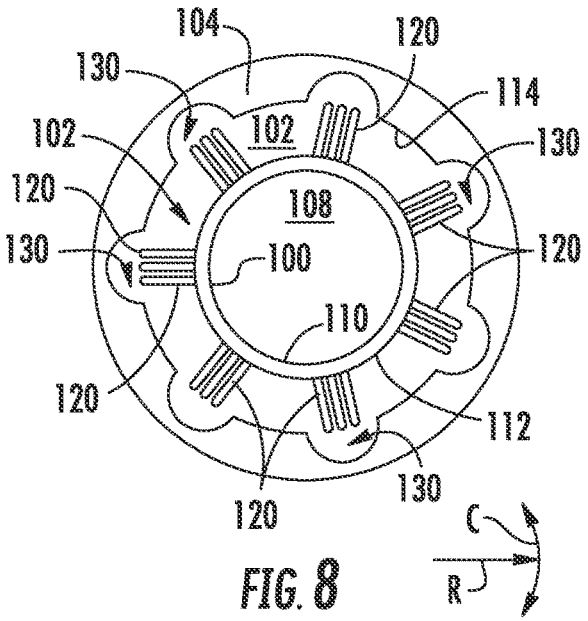
FIG. 8 is a top view of an embodiment of the impingement insert and the hot gas path component in accordance with embodiments of the present disclosure.
Figure 9:
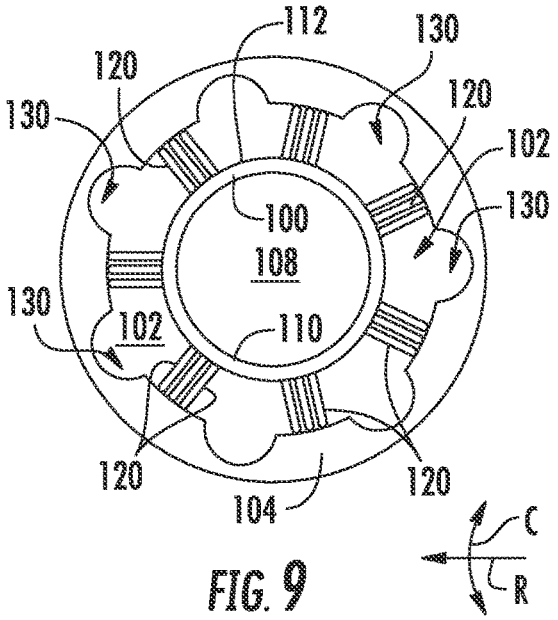
FIG. 9 is a top view of an embodiment of the impingement insert and the hot gas path component in accordance with embodiments of the present disclosure.

In another embodiment illustrated in FIGS. 8 and 9, the hot gas path component 104 defines one or more axially extending slots 130 that receive the projections 120 during insertion of the impingement insert 100 into the hot gas path component cavity 102. In general, the number of slots 130 may correspond to the number of linear rows 122 of projections 120 on the impingement insert 100. If the linear rows 122 of projections 120 are grouped, the number of slots 130 may correspond to the number of groups of linear rows 122. In the embodiment shown in FIGS. 8 and 9, the impingement insert 100 includes three linear rows 122 of projections 120 arranged in seven groups. As such, the hot gas path component 104 defines seven slots 130 to receive the seven groups of projections 120.

As shown in FIGS. 8 and 9, the slots 130 extend radially outward from the inner surface 114 of the hot gas path component 130. The slots 130 preferably extend along substantially the entire axial length of the inner surface 114. In alternate embodiments, the slots 130 may extend for only a portion of the axial length of the inner surface 114. The slots 130 may generally be circumferentially wider than the corresponding linear row 122 or group of linear rows 122 of projections 120. As shown, the slots 130 have a semi-circular cross-section. Although, the slots 130 may have any suitable cross-section (e.g., rectangular) in other embodiments. The slots 130 may be evenly or unevenly circumferentially spaced apart.

FIGS. 8 and 9 illustrate the relative positioning of the projections 120 and the slots 130 during different stages of the installation of the impingement insert 100 in the hot gas path component 104. Referring particularly to FIG. 8, each group of projections 120 is circumferentially aligned with one of the slots 130 during insertion of the impingement insert 100 in the hot gas path component cavity 102. In this respect, the projections 120 are radially spaced apart from and do not contact the hot gas path component 104 during insertion. Once fully inserted into hot gas path component cavity 102, the impingement insert 100 is rotated in the circumferential direction C to permit the projections 120 to contact the inner surface 114 of the hot gas path component 104. As such, the projections 120 and the slots 130 are circumferentially spaced apart after the impingement insert 100 is installed into hot gas path component 104 as illustrated in FIG. 9.

Figure 10:
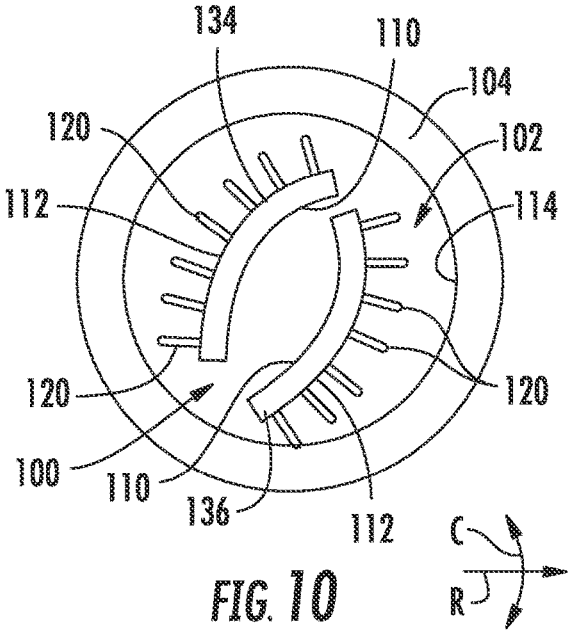
FIG. 10 is a top view of an embodiment of the impingement insert and the hot gas path component in accordance with embodiments of the present disclosure.
Figure 11:
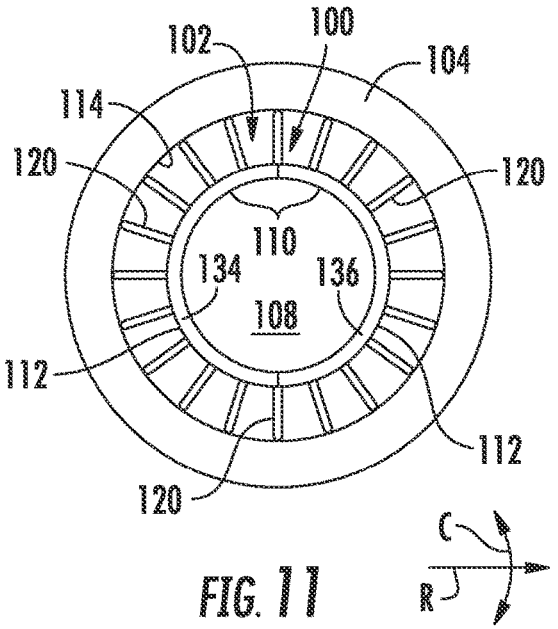
FIG. 11 is a top view of an embodiment of the impingement insert and the hot gas path component in accordance with embodiments of the present disclosure.

In a further embodiment illustrated in FIGS. 10 and 11, the impingement insert 100 may include a plurality of impingement insert portions that permits installation of the impingement insert 100 into the hot gas path component cavity 102. Each impingement insert portion generally includes a portion of the projections 120 on the impingement insert 100. As shown, the impingement insert 100 may include a first impingement insert portion 132 and a second impingement insert portion 134. In alternate embodiments, the impingement insert 100 may include three or more impingement insert portions.

FIGS. 10 and 11 illustrate the relative positioning of the first and second impingement insert portions 134, 136 during different stages of the installation of the impingement insert 100 in the hot gas path component 104. Referring particularly to FIG. 10, the first and second impingement insert portions 134, 136 are inserted into the hot gas path component cavity 102. In particular, the first and second impingement inserts 134, 136 are configured such the projections 120 do not contact the inner surface 114 of the hot gas path component 104 during insertion. Once fully inserted into hot gas path component cavity 102, the first and second impingement inserts 134, 136 are oriented to form the general configuration of the impingement insert 100. The first and second impingement insert portions 134, 136 are then forced radially outward and coupled to form the impingement insert 110 as shown in FIG. 11. The first and second impingement inserts 134, 136 may be forced outward via a pressurized fluid (e.g., compressed air from a pump), a mechanical actuator (e.g., a cam), or any other suitable device or method.

In operation, the impingement insert 100 provides convective and conductive cooling to the hot gas path component 104. More specifically, cooling air (e.g., a portion of the compressed air 38) flows axially through the impingement insert cavity 108. The impingement apertures 116 direct a portion of the cooling air flowing through the impingement insert 100 onto the inner surface 114 of the hot gas path component 104. That is, the cooling air flows through the impingement apertures 116 and the hot gas path component inner cavity 102 until striking the inner surface 114 of the hot gas path component 104. As such, impingement apertures 116 provide convective cooling (i.e., impingement cooling) to the hot gas path component 104. As mentioned above, the projections 120 extend from the outer surface 112 of the impingement insert 100 to the inner surface 114 of the hot gas path component 104. In this respect, heat may be conducted from the hot gas path component through the projections 120 to the impingement insert 100. The cooling air flowing through the impingement insert cavity 108 may absorb the heat conductively transferred to the impingement insert 100 by the projections 120.

As discussed in greater detail above, the impingement apertures 116 convectively cool the hot gas path component 104, and the projections 120 conductively cool the hot gas path component 104. Since the impingement insert 100 provides both convective and conductive cooling to the hot gas path component 100, the impingement insert 100 provides greater cooling to the hot gas path component 104 than conventional impingement inserts. As such, the impingement insert 100 may define fewer impingement apertures 116 than conventional inserts. Accordingly, the impingement insert 100 diverts less compressed air 38 from the compressor section 12 (FIG. 1) than conventional impingement inserts, thereby increasing the efficiency of the gas turbine engine 10.

FIGS. 12-15 illustrate embodiments of an impingement insert 200, which may be positioned the hot gas path component cavity 102 of the hot gas path component 104. As shown, the impingement insert 200 defines an axial direction A, a radial direction R, and a circumferential direction C. In general, the radial direction R extends orthogonally outward from the axial direction A, and the circumferential direction C extends concentrically around the axial direction A.

Figure 12:
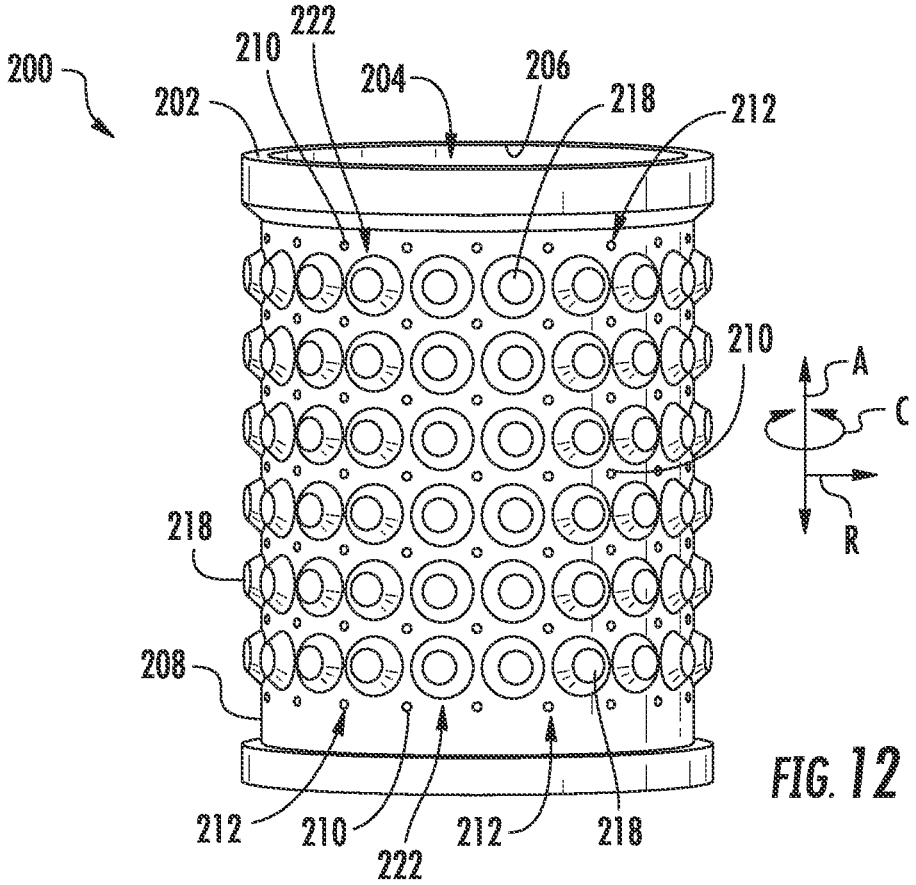
FIG. 12 is a perspective view of an embodiment of the impingement insert in accordance with embodiments of the present disclosure.

Referring particularly to FIG. 12, the impingement insert 200 includes a generally tubular insert wall 202 that defines an impingement insert cavity 204 therein. In this respect, the insert wall 202 includes an inner surface 206, which forms the outer boundary of the inner cavity 204, and an outer surface 208 spaced apart from the inner surface 206. In the embodiment illustrated in FIG. 12, the insert wall 202 generally has an annular cross-section. Although, the insert wall 202 may have any suitable shape in other embodiments as well.

As mentioned above, the impingement insert 200 is positioned a hot gas path component cavity 102 of a hot gas path component 104. More specifically, the impingement insert 200 is positioned within the hot gas path component cavity 102 in such a manner that the outer surface 208 of the insert wall 206 is radially spaced apart from the inner surface 114 of the hot gas path component 104. The spacing between outer surface 108 of the insert wall 102 and the inner surface 114 of the hot gas path component 104 should be sized to facilitate impingement cooling of the inner the inner surface 114 as will be discussed in greater detail below.

The impingement insert 200 defines a plurality of impingement apertures 210. In particular, the impingement apertures 210 extend through the insert wall 202 from the inner surface 206 thereof through the outer surface 208 thereof. The impingement apertures 208 provide fluid communication between the impingement insert cavity 204 and the hot gas path component cavity 102. The impingement apertures 210 preferably have a circular cross-section. Although, the impingement apertures 210 may have any suitable cross-section (e.g., rectangular). Furthermore, the impingement apertures 210 are sized to provide impingement cooling to the inner surface 114 of the hot gas path component 104.

In the embodiment shown in FIG. 12, the impingement apertures 210 are arranged in linear rows 212. The linear rows 212 of impingement apertures 210 may extend along substantially the entire axial length of the insert wall 202 or only a portion thereof. The impingement apertures 210 may be arranged into any suitable number of linear rows 212. In alternate embodiments, however, the plurality of impingement apertures 210 may be arranged on the impingement insert 200 in any manner that facilitates impingement cooling of the inner the inner surface 114.

Figure 13:
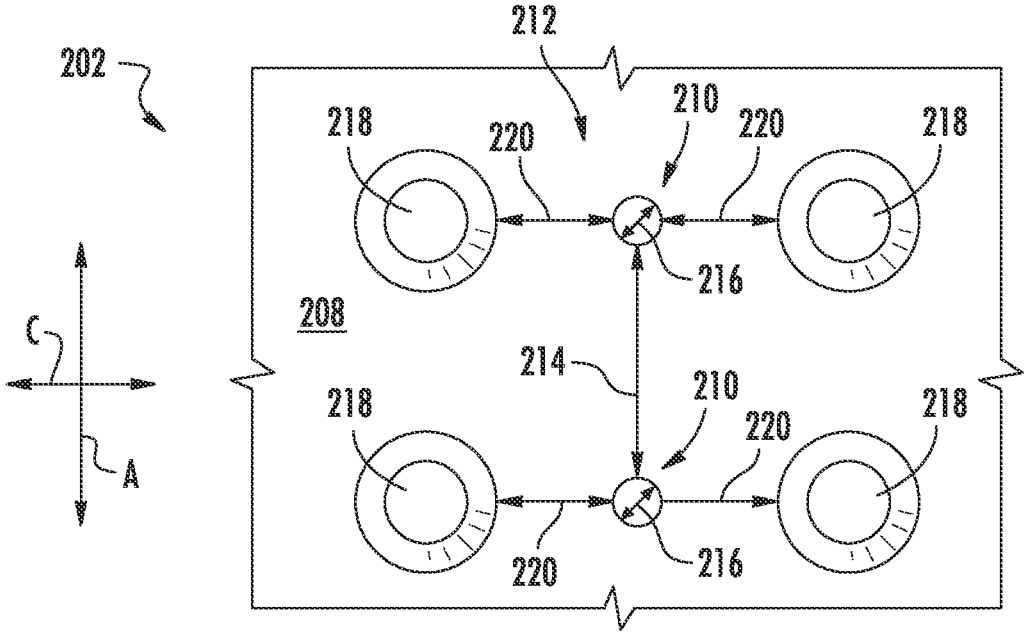
FIG. 13 is a front view of an embodiment of the impingement insert in accordance with embodiments of the present disclosure.

Referring now to FIG. 13, each impingement aperture 210 may be spaced apart from all of the other impingement apertures 210 by a minimum distance 214. In certain embodiments, the minimum distance 214 may be based on a diameter 216 of the corresponding impingement apertures 210. For example, the minimum distance 214 may be fifteen times the diameter 216 of the corresponding impingement apertures 210. Nevertheless, the minimum distance 214 may be larger (e.g., twenty times the diameter 216) or smaller (ten times the diameter 216) in alternate embodiments. In embodiments where the impingement apertures 210 are different sizes, the minimum distance 214 may be based on the diameter 216 of the larger impingement aperture 216.

Referring now to FIGS. 12-15, the impingement insert 200 includes a plurality of projections 218 extending outwardly from the outer surface 208 of the insert wall 106. In particular, the projections 218 increase the surface area of the outer surface 208 of the impingement insert 200. Unlike the projections 120, the projections 218 do not contact the inner surface 114 of the hot gas path component 104. The projections 218 may be pins as shown in FIGS. 12-15 or fins. The projections 218 may have a circular cross-section, a rectangular cross-section, or any other suitable cross-sectional. In certain embodiments, the projections 218 may be tapered. For example, the projections 218 may be frustoconical as shown in FIGS. 12 and 13. In other embodiments, the projections 218 may have a constant cross-sectional size.

Figure 14:
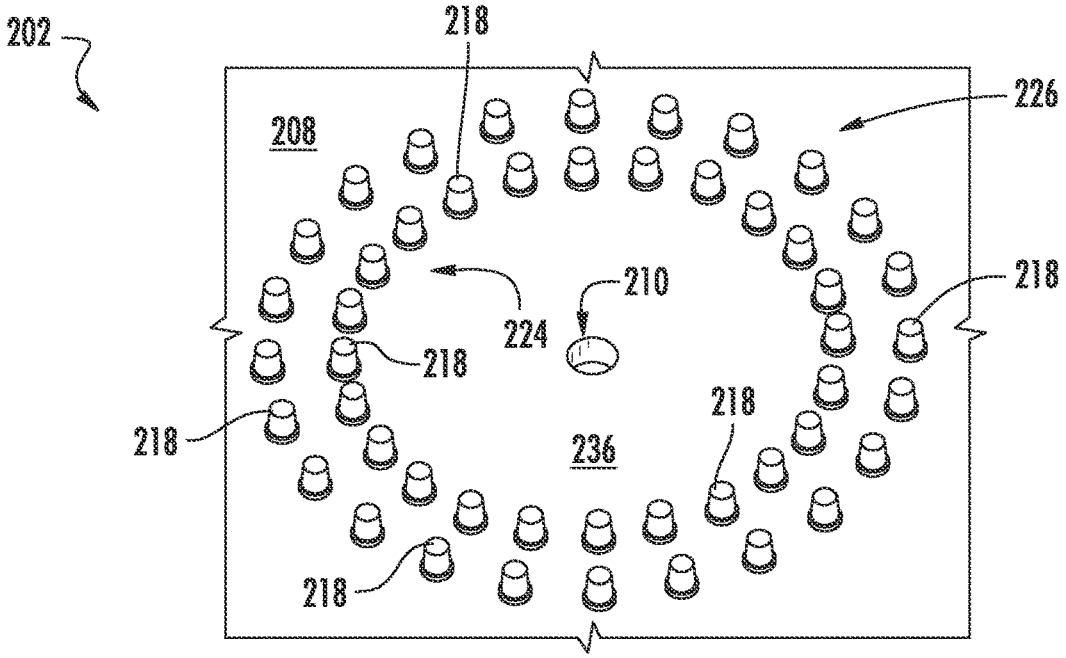
FIG. 14 is a front view of an embodiment of the impingement insert in accordance with embodiments of the present disclosure.
Figure 15:
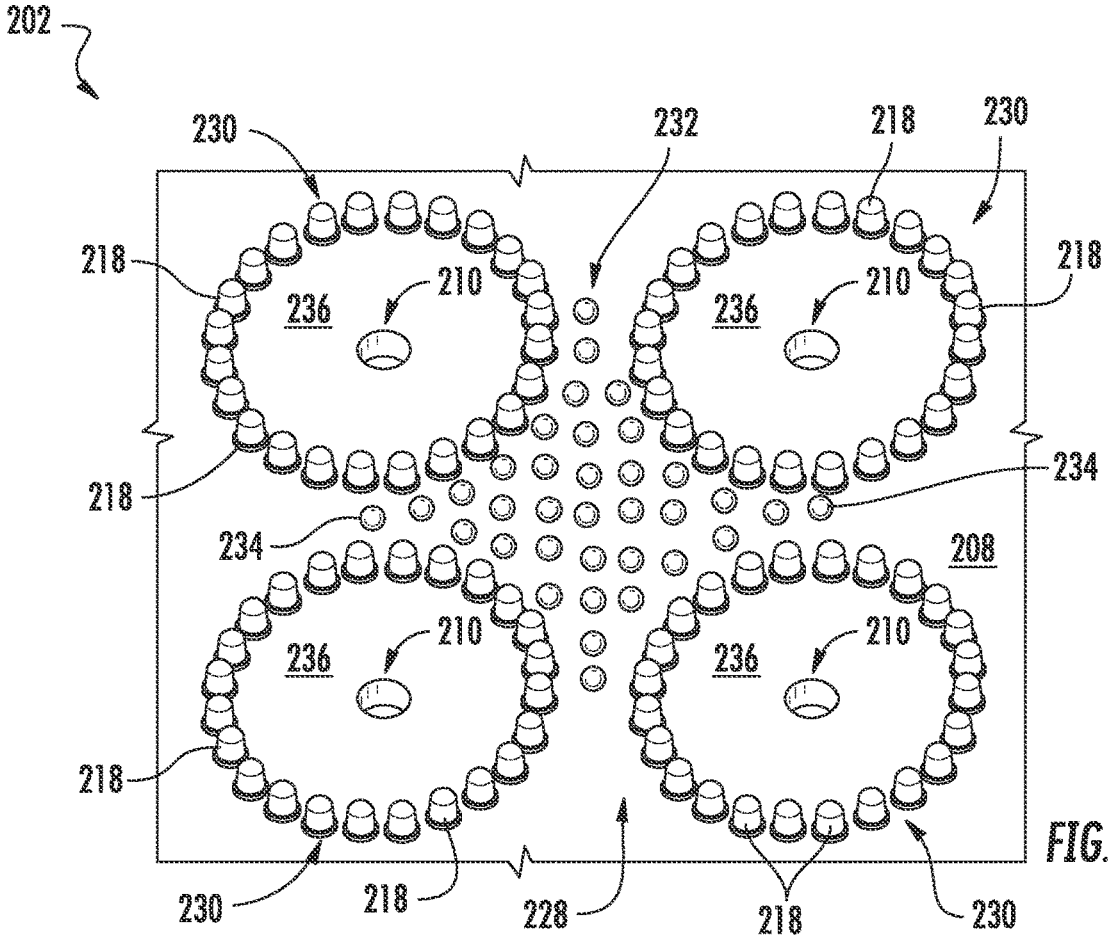
FIG. 15 is a front view of an embodiment of the impingement insert in accordance with embodiments of the present disclosure.

As illustrated in FIG. 13, all of the projections 218 may be spaced apart from each of the impingement apertures 210 by a minimum distance 220. That is, each projection 218 is at least the minimum distance 220 from all of the impingement apertures 210. In particular, the minimum distance 220 may be two times the diameter 216 of the corresponding impingement apertures 210. In embodiments where the impingement apertures 210 are different sizes, the minimum distance 220 may be based on the diameter 216 of the larger impingement aperture 210. As shown in FIGS. 14 and 15, the minimum distance 220 between the impingement apertures 210 and the projections 218 creates a smooth zone 236 surrounding each impingement aperture 210. Specifically, the smooth zone 236 is devoid of projections 218, bumps, dimples, and other surface roughness. As will be discussed in greater detail below, the smooth zone 236 provides improved impingement cooling.

The projections 218 may be arranged on the outer surface 208 of the insert wall 202 in any suitable manner, so long as each projection 218 is at least the minimum distance 220 from all of the impingement apertures 210. In the embodiment shown in FIG. 12, for example, the projections 218 are arranged in linear rows 222. The linear rows 222 of projections 218 may extend along substantially the entire axial length of the insert wall 106 or only a portion thereof. One linear row 222 of projections 218 is circumferentially positioned between each adjacent pair of the linear rows 212 of impingement apertures 210 in the embodiment shown in FIG. 12. Nevertheless, the impingement apertures 210 may be arranged in any suitable number of linear rows 222.

The projections 218 may be arranged in one or more rings enclosing each of the impingement apertures 210. In the embodiment shown in FIG. 14, a first ring 224 of projections 218 encloses one of the impingement apertures 210. A second ring 226 of projections 218 is encloses and is concentric with the first ring 224 of projections 218. The first ring 224 of projections 218 is spaced apart from the impingement apertures 210 by the minimum distance 220. The second ring 226 of projections 218 is spaced apart from the impingement apertures 210 by a distance greater than the minimum distance 220. In alternate embodiments, one ring of projections 218 (as shown in FIG. 15), three rings of projections 218, or more rings of projections 218 may enclose each impingement aperture 210.

Referring now to FIG. 15, some embodiments of the impingement insert 200 may include a space 228 between the rings of projections 218 surrounding different impingement apertures 210. As shown, four impingement apertures 210 are each enclosed by a ring 230 of projections 218. The spacing of the impingement apertures 210 and the projections 218 is such that the space 228 is present between the different rings 230. In this respect, the space 228 may include a roughened portion 232. In particular, the roughened portion 232 may include dimples 234 as shown in FIG. 15, bumps, or any other suitable surface roughness. In alternate embodiments, the space 228 may be smooth.

As with the impingement insert 100, the impingement insert 200 may be formed via additive manufacturing methods.

In operation, the impingement insert 200 provides convective cooling to the hot gas path component 104. More specifically, cooling air (e.g., a portion of the compressed air 38) flows axially through the impingement insert cavity 204. The impingement apertures 210 direct a portion of the cooling air flowing through the impingement insert 200 onto the inner surface 114 of the hot gas path component 104. That is, the cooling air flows through the impingement apertures 210 and the hot gas path component cavity 102 until striking the inner surface 114 of the hot gas path component 104. As such, the impingement apertures 210 provide impingement cooling to the hot gas path component 104. As mentioned above, the projections 218 increase the surface area of the outer surface 208 of the insert wall 202. In this respect, the projections 218 facilitate increased convective heat transfer between the cooling air present in the hot gas path component cavity 102 and the impingement insert 200.

The smooth zone 236 created by the minimum distance 220 may provide improved impingement cooling by the impingement apertures 210. More specifically, placing projections, bumps, dimples, or other surface roughness within two diameters of the impingement apertures 210 decreases the efficiency of the impingement apertures 210. That is, projections, bumps, dimples, or other surface roughness may interfere with the impingement jets exiting the impingement apertures 210. The smooth zone 236, however, does not include surface roughness that could interfere with the impingement jets exiting the impingement apertures 210.

As discussed in greater detail above, the smooth zone 236 created by the minimum distance 220 may provide improved impingement cooling by the impingement apertures 210. Furthermore, the use of the projections 218 outside of the smooth zone 236 increases the heat transfer between cooling air in the hot gas path component cavity 102 and the impingement insert 200. In this respect, the impingement insert 200 provides greater cooling to the hot gas path component 104 than conventional impingement inserts. As such, the impingement insert 200 may define fewer impingement apertures 210 than conventional inserts. Accordingly, the impingement insert 200 diverts less compressed air 38 from the compressor section 12 (FIG. 1) than conventional impingement inserts, thereby increasing the efficiency of the gas turbine engine 10.

As discussed above and shown in FIGS. 12-15, the impingement apertures 210 and the projections 218 are integrated into the impingement insert 100. In alternate embodiments, the impingement apertures 210 and the projections 218 may be integrated into an impingement plate as mentioned above. Furthermore, the impingement apertures 210 and the projections 218 may be integrated in an end wall or one of the shrouds 44A-C.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A hot gas path component for a turbomachine, the hot gas path component comprising:

an inner component surface partially defining a hot gas path component cavity; and an impingement insert comprising:

an insert wall having an inner surface and an outer surface, the impingement insert positioned within the hot gas path component such that the hot gas path component cavity is defined between the inner surface of the hot gas path component and the outer surface of the impingement insert, the inner surface of the impingement insert defining an impingement insert cavity within the impingement insert;

a plurality of projections extending from the outer surface of the impingement insert through the hot gas path component cavity to the inner component surface, each projection of the plurality of projections including a first end coupled to the outer surface of the impingement insert and a second end that is axially and radially spaced apart from the first end, wherein the plurality of projections is arranged in linear rows along the axial direction; and a plurality of impingement apertures defined through the impingement insert and fluidly coupling the impingement insert cavity to the hot gas path component cavity, the plurality of impingement apertures being arranged in linear rows and positioned between the linear rows of projections.

2. The hot gas path component of claim 1, wherein an angle is defined between each projection of the plurality of projections and the outer surface of the impingement insert, the angle being between thirty degrees and sixty degrees.

3. The hot gas path component of claim 1, wherein each projection of the plurality of projections is oblique to both the outer surface of the impingement insert and the inner component surface of the hot gas path component.

4. The hot gas path component of claim 1, wherein a first radial distance is defined between each projection in a first linear row of projections of the linear rows of projections and a radially neighboring projection in the first linear row of projections; and wherein a second radial distance is defined between each impingement aperture in a first linear row of impingement apertures of linear rows of apertures and a radially neighboring impingement aperture in the linear row of impingement apertures, and wherein the second radial distance is larger than the first radial distance.

5. The hot gas path component of claim 1, wherein the linear rows of projections are radially spaced apart from the linear rows of impingement apertures.

6. The hot gas path component of claim 1, wherein multiple linear rows of projections are positioned between a pair of the linear rows of impingement apertures.

7. The hot gas path component of claim 6, wherein the multiple linear rows of projections comprise a first linear row of projections, a second linear row of projections, and a third linear row of projections.

8. The hot gas path component of claim 1, wherein the plurality of projections is fixedly coupled to the impingement insert and removably contacts the hot gas path component.

9. The hot gas path component of claim 1, wherein the plurality of projections and the plurality of impingement apertures extend along the entire axial length of the insert wall.

10. The hot gas path component of claim 1, wherein the hot gas path component is a stator vane, a rotor blade, or shroud.

11. A turbomachine comprising:

a compressor section;

a combustor section disposed downstream from the compressor section;

a turbine section disposed downstream from the combustor section; and a hot gas path component disposed within the turbine section, the hot gas path component comprising:

an inner component surface partially defining a hot gas path component cavity; and an impingement insert comprising:

an insert wall having an inner surface and an outer surface, the impingement insert positioned within the hot gas path component such that the hot gas path component cavity is defined between the inner surface of the hot gas path component and the outer surface of the impingement insert, the inner surface of the impingement insert defining an impingement insert cavity within the impingement insert;

a plurality of projections extending from the outer surface of the impingement insert through the hot gas path component cavity to the inner component surface, each projection of the plurality of projections including a first end coupled to the outer surface of the impingement insert and a second end that is axially and radially spaced apart from the first end, wherein the plurality of projections is arranged in linear rows along the axial direction; and a plurality of impingement apertures defined through the impingement insert and fluidly coupling the impingement insert cavity to the hot gas path component cavity, the plurality of impingement apertures being arranged in linear rows and positioned between the linear rows of projections.

12. The turbomachine of claim 11, wherein an angle is defined between each projection of the plurality of projections and the outer surface of the impingement insert, the angle being between thirty degrees and sixty degrees.

13. The turbomachine of claim 11, wherein each projection of the plurality of projections is oblique to both the outer surface of the impingement insert and the inner component surface of the hot gas path component.

14. The turbomachine of claim 11, wherein a first radial distance is defined between each projection in a first linear row of projections of the linear rows of projections and a radially neighboring projection in the first linear row of projections; and wherein a second radial distance is defined between each impingement aperture in a first linear row of impingement apertures of the linear rows of apertures and a radially neighboring impingement aperture in the first linear row of impingement apertures; and wherein the second radial distance is larger than the first radial distance.

15. The turbomachine of claim 11, wherein the linear rows of projections are radially spaced apart from the linear rows of impingement apertures.

16. The turbomachine of claim 11, wherein multiple linear rows of projections are positioned between a pair of the linear rows of impingement apertures.

17. The turbomachine of claim 16, wherein the multiple linear rows of projections comprise a first linear row of projections, a second linear row of projections, and a third linear row of projections.

18. The turbomachine of claim 11, wherein the plurality of projections is fixedly coupled to the impingement insert and removably contacts the hot gas path component.

19. The turbomachine of claim 11, wherein the plurality of projections and the plurality of impingement apertures extend along the entire axial length of the insert wall.

20. The turbomachine of claim 11, wherein the hot gas path component is a stator vane, a rotor blade, or shroud.

* * * * *